US008988300B2

(12) United States Patent
Runyon et al.

(10) Patent No.: US 8,988,300 B2
(45) Date of Patent: Mar. 24, 2015

(54) DUAL-CIRCULAR POLARIZED ANTENNA SYSTEM

(71) Applicant: ViaSat, Inc., Carlsbad, CA (US)

(72) Inventors: Donald Lawson Runyon, Duluth, GA (US); Dominic Quang Nguyen, Duluth, GA (US); James W. Maxwell, Alpharetta, GA (US)

(73) Assignee: Viasat, Inc., Carlsbad, CA (US)

( * ) Notice: Subject to any disclaimer, the term of this patent is extended or adjusted under 35 U.S.C. 154(b) by 363 days.

(21) Appl. No.: 13/707,160

(22) Filed: Dec. 6, 2012

(65) Prior Publication Data

US 2013/0141300 A1 Jun. 6, 2013

Related U.S. Application Data

(60) Provisional application No. 61/567,586, filed on Dec. 6, 2011.

(51) Int. Cl.
*H01Q 13/02* (2006.01)
*H01P 5/12* (2006.01)
(Continued)

(52) U.S. Cl.
CPC ..... *H01P 5/12* (2013.01); *H01P 11/001* (2013.01); *Y10T 29/49016* (2015.01); *Y10T 29/49002* (2015.01); *H01Q 1/02* (2013.01); *H01P 11/00* (2013.01); *H01Q 13/0233* (2013.01); *H01Q 21/0037* (2013.01)
USPC ..... 343/776; 343/756

(58) Field of Classification Search
CPC ..... H01Q 21/0037; H01Q 13/0233; H01P 11/00; H01P 5/12
USPC ..... 343/772, 776, 786, 756, 762
See application file for complete search history.

(56) References Cited

U.S. PATENT DOCUMENTS 4,743,915 A 5/1988 Rammos et al.
4,783,663 A 11/1988 Rammos et al.
(Continued)

FOREIGN PATENT DOCUMENTS

EP 0228743 A1 7/1987
EP 1930982 B1 10/2010
(Continued)

OTHER PUBLICATIONS

Dittloff et al., Computer Aided Design of Optimum E- or H-Plane N-Furcated Waveguide Power Dividers, 17th European Microwave Conference, Sep. 7, 1987 to Sep. 11, 1987, pp. 181-186.
(Continued)

*Primary Examiner* — Hoanganh Le
(74) *Attorney, Agent, or Firm* — Viasat, Inc.

(57) ABSTRACT

In an example embodiment, an azimuth combiner comprises: a septum layer comprising a plurality of septum dividers; first and second housing layers attached to first and second sides of the septum layer; a linear array of ports on a first end of the combiner; wherein the first and second housing layers each comprise waveguide H-plane T-junctions; wherein the waveguide T-junctions can be configured to perform power dividing/combining; and wherein the septum layer evenly bisects each port of the linear array of ports. A stack of such azimuth combiners can form a two dimensional planar array of ports to which can be added a horn aperture layer, and a grid layer, to form a dual-polarized, dual-BFN, dual-band antenna array.

20 Claims, 11 Drawing Sheets

(51) Int. Cl.

| | |
|---|---|
| ***H01P 11/00*** | (2006.01) |
| ***H01Q 1/02*** | (2006.01) |
| ***H01Q 21/00*** | (2006.01) |

(56) References Cited

U.S. PATENT DOCUMENTS

| | | | | |
|---|---|---|---|---|
| 4,795,993 | A | 1/1989 | Park et al. | |
| 5,086,304 | A * | 2/1992 | Collins | 343/778 |
| 5,243,357 | A | 9/1993 | Koike et al. | |
| 5,291,650 | A | 3/1994 | Carvalho et al. | |
| 5,568,160 | A | 10/1996 | Collins | |
| 6,034,647 | A | 3/2000 | Paul et al. | |
| 6,201,508 | B1 | 3/2001 | Metzen et al. | |
| 6,225,960 | B1 | 5/2001 | Collins | |
| 6,411,174 | B1 | 6/2002 | Crouch et al. | |
| 6,563,398 | B1 | 5/2003 | Wu | |
| 7,564,421 | B1 | 7/2009 | Edwards et al. | |
| 7,927,402 | B1 | 4/2011 | Grzeslak et al. | |
| 8,477,075 | B2 | 7/2013 | Seifried et al. | |
| 8,558,746 | B2 | 10/2013 | Thomson et al. | |
| 8,587,492 | B2 | 11/2013 | Runyon | |
| 2004/0178863 | A1 | 9/2004 | Chan et al. | |
| 2006/0226931 | A1 | 10/2006 | Tavassoli Hozouri | |
| 2007/0182507 | A1 | 8/2007 | Chang et al. | |
| 2010/0102899 | A1 * | 4/2010 | Engel | 333/117 |
| 2010/0259346 | A1 | 10/2010 | Runyon | |
| 2011/0043422 | A1 * | 2/2011 | Lin et al. | 343/756 |
| 2011/0061539 | A1 | 3/2011 | Lam et al. | |
| 2011/0156838 | A1 | 6/2011 | Huang et al. | |
| 2011/0267250 | A1 | 11/2011 | Seifried et al. | |
| 2012/0218160 | A1 | 8/2012 | Montgomery et al. | |
| 2013/0141186 | A1 | 6/2013 | Nguyen et al. | |
| 2013/0141288 | A1 | 6/2013 | Voss et al. | |
| 2013/0154764 | A1 | 6/2013 | Runyon et al. | |
| 2013/0278474 | A1 | 10/2013 | Lenormand et al. | |
| 2013/0321229 | A1 | 12/2013 | Klefenz et al. | |

FOREIGN PATENT DOCUMENTS

| | | | |
|---|---|---|---|
| EP | 2237371 | A2 | 10/2010 |
| EP | 2287969 | A1 | 2/2011 |
| EP | 2654126 | A1 | 10/2013 |
| WO | 02/09227 | A1 | 1/2002 |
| WO | 2006/061865 | A1 | 6/2006 |
| WO | 2008/069369 | A1 | 6/2008 |

OTHER PUBLICATIONS

Goldfarb, A Recombinant, In-Phase Power Divider, IEEE Transactions on Microwave Theory and Techniques, vol. 39, No. 8, Aug. 1991, pp. 1438-1440.

Rebollar et al., Design of a Compact KA-Band Three-Way Power Divider, IEEE, 1994, 0-7803-2009-3/94, pp. 1074-1077.

Sehm et al., A Large Planar Antenna Consisting of an Array of Waveguide Fed Horns, 26th EuMC, Sep. 9, 1996 to Sep. 12, 1996, Prague, Czech Republic, pp. 610-613.

Christopher et al., Design Aspects of Compact High Power Multiport Unequal Power Dividers, IEEE, 1996, 0-7803-3232-6/96, pp. 63-67.

Dudko et al., A Wide Band Matching of H-Plane Tee, MMET '96 Proceedings, Lviv, Ukraine, VIth Int'l. Conf. on Mathematical Methods in Electromagnetic Theory, 1996, pp. 309-312.

Joubert et al., Design of Unequal H-Plane Waveguide Power Dividers for Array Applications, IEEE, 1996, 0-7803-3216-4/96, pp. 1639-1639.

Wollack, On the Compensation of E-Plane Bifrucations in Rectangular Waveguide, NRAO, Charlottesville, VA, Oct. 20, 1997.

Gardner et al., Mode Matching Design of Three-Way Waveguide Power Dividers, The Institute of Electrical Engineers, 1997, London, UK, 4 pgs.

Sehm et al., A Large Planar 39-GHz Antenna Array of Waveguide-Fed Horns, IEEE Transactions on Antennas and Propagation, vol. 46, No. 8, Aug. 1998, pp. 1189-1193.

Soroka et al., Simulation of Multichannel Waveguide Power Dividers, MSMW '98 Symposium Proceedings, Kharkov, Ukraine, Sep. 15, 1998 to Sep. 17, 1998, pp. 634-635.

Sehm et al., A 38 GHz Horn Antenna Array, 28th European Microwave Conference Amsterdam 1998, pp. 184-189.

Hersey et al., Self Regenerating Desiccant for Water Management in External Aircraft Electronics, IEEE, Aerospace Conference, Mar. 6, 1999 to Mar. 13, 1999, pp. 183-191.

Sehm et al., A High-Gain 58-GHz Box-Horn Array Antenna With Suppressed Grating Lobes, IEEE Transactions on Antennas and Propagation, vol. 47, No. 7, Jul. 1999, pp. 1125-1130.

Sehm et al., A 64-Element Array Antenna for 58 GHz, IEEE, 1999, 0-7803-5639-X/99, pp. 2744-2747.

Kerr, Alma Memo 381—Elements for E-Plane Split-Block Waveguide Circuits, http://www.mma.nrao.edu/memos/, Jul. 5, 2001.

Bozzi et al., A Compact, Wideband, Phase-Equalized Waveguide Divider/Combiner for Power Amplification, 33rd European Microwave Conference, Munich, 2003, pp. 155-158.

Yang et al., Synthesis of a Compound T-Junction for a Two-Way Splitter With Arbitrary Power Ratio, IEEE, 2005, 0-7803-8846-1/05, pp. 985-988.

Panda et al., Multiple Cavity Modeling of a Feed Network for Two Dimensional Phased Array Application, Progress in Electromagnetics Research Letters, vol. 2, 2008, pp. 135-140.

Mestezky et al., Unequal, Equi-Phase, 1:N Power Divider Based on a Sectoral Waveguide, Int'l. Journal of Microwave and Optical Technology, vol. 4, No. 3, May 2009, pp. 170-174.

Kim et al., Design of High Power Split Waveguide Array in W-Band, IEEE, 2009, 978-1-4244-5417-4/09, 2 pgs.

Chen et al., An Ultra Wide Band Power Divider/Combiner Based on Y-Structure Waveguide, IEEE, ICMMT 2010 Proceedings, 2010, 978-1-4244-5708-3/10, pp. 853-855.

* cited by examiner

DUAL-CIRCULAR POLARIZED ANTENNA SYSTEM

CROSS-REFERENCE TO RELATED APPLICATIONS

This application claims priority to U.S. Provisional Application No. 61/567,586, entitled "Mobile Antenna," which was filed on Dec. 6, 2011, the contents of which are hereby incorporated by reference for any purpose in their entirety.

FIELD OF INVENTION

The present disclosure relates generally to radio frequency (RF) antenna systems and methods for making the same, and specifically to dual-circular, polarized, dual band RF antenna systems.

BACKGROUND

Horn type RF antenna devices typically comprise waveguide power dividers/combiners to divide/combine signals between a common port and an array of horn elements, As the number of horn elements in an antenna array increases, the waveguide power divider/combiner structure becomes increasingly complex and space consuming. This can be problematic in many environments where space and/or weight can be at a premium. Moreover, efforts thus far to create more compact, lighter waveguide power divider/combiner structures have often times resulted in systems that have undesirable performance results.

In particular, it has been difficult to create small/light weight dual-polarized, dual-beam forming network, dual-band, full-duplex array antenna systems. This is particularly true where the dual band array system has a broad frequency range between the two bands, and where the antenna has simultaneous dual-circular (CP) polarization.

New devices and methods of manufacturing improved RF antenna systems are now described.

SUMMARY

In an example embodiment, an azimuth combiner can comprise: a septum layer comprising a plurality of septum dividers. The septum layer can have a first side and a second side, and be oriented in a first plane. A first housing layer can be attached to the first side of the septum layer, and oriented in a second plane. A second housing layer can be attached to the second side of the septum layer; and oriented in a third plane. In a coordinate system comprising an X axis, a Y axis, and a Z axis that are perpendicular to each other, the first, second and third planes can be parallel to each other and to a plane defined by the Y axis and the Z axis. The combiner can comprise a linear array of ports on a first end of the combiner, the linear array of ports being aligned in parallel with the Y direction and opening in the Z direction. The first and second housing layers can each comprise waveguide T-junctions oriented in planes parallel to the plane defined by the Y axis and the Z axis; wherein the waveguide T-junctions can be configured to perform power dividing/combining; and wherein the septum layer can evenly bisect each port of the linear array of ports.

A dual-polarized, dual-beam forming network (BFN), dual-band antenna array, can comprise: as stack of azimuth combiners comprising dual band septum polarizers; a horn aperture layer, wherein the horn aperture layer can be one of flared or stepped; and a grid layer, the grid layer having plural mode matching features over the horn aperture layer and fed by the stack of combiners, wherein the stack of combiners can be perpendicular to the horn aperture layer.

A method of making a dual-polarized, dual-BFN, dual-band combiner, can comprise: forming first and second inner housing layers each comprising waveguide T-junctions that can be oriented in planes parallel to a Y-Z plane in a coordinate system defined by X, Y, and Z axis that can be each perpendicular to each other; attaching the first inner housing layer to a first side of a septum polarizer layer, wherein the septum polarizer layer can be oriented in a plane parallel to the Y-Z plane; and attaching the second inner housing layer to a second side of the septum polarizer layer; wherein the combiner comprises a plurality of dual circularly polarized ports linearly laid out in the Y direction on a first end of the combiner and a common port corresponding to at least one polarization on a second end of the combiner opposite the first end of the combiner.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
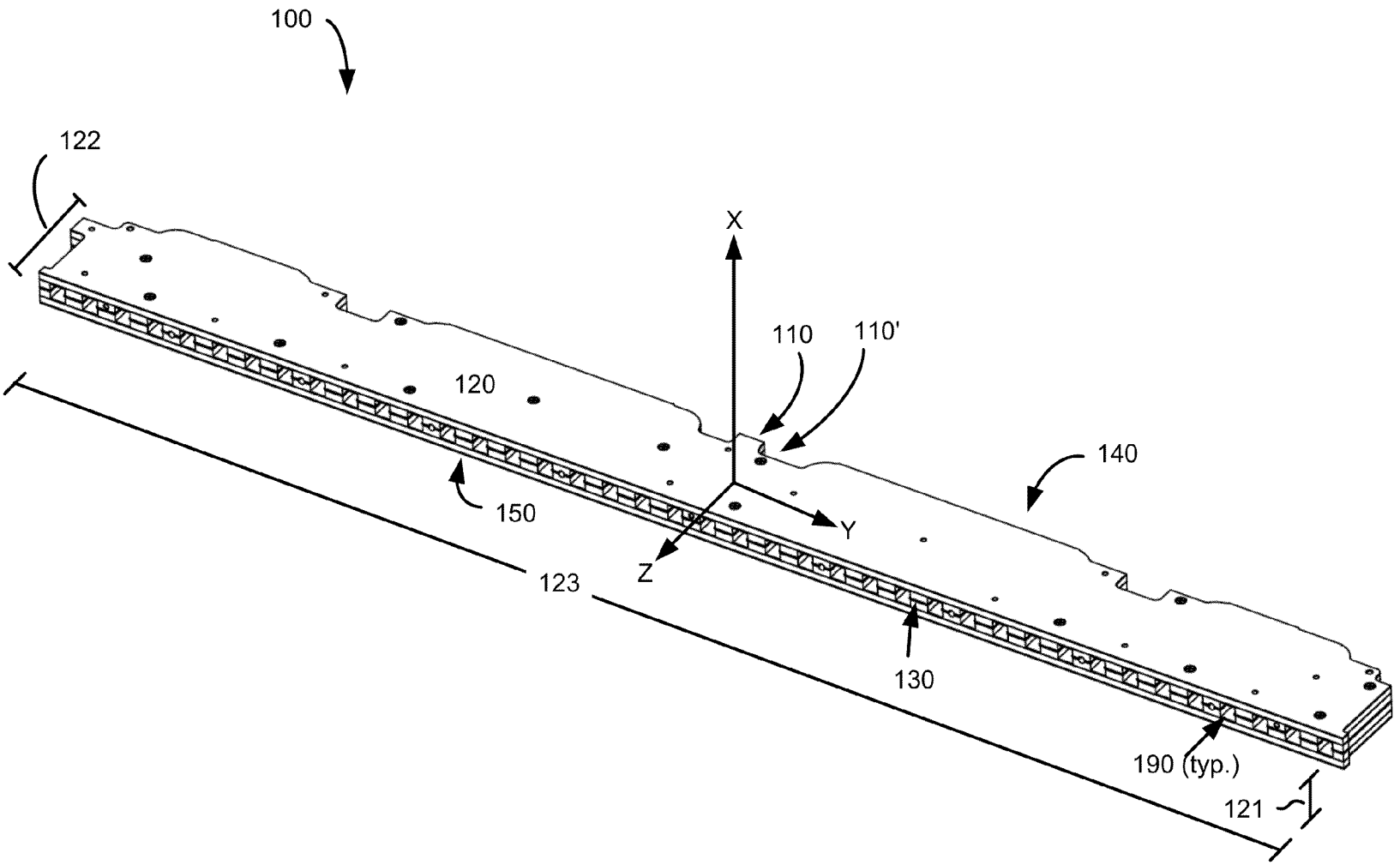
FIG. 1 is a perspective view of an example azimuth combiner.

Reference will now be made to the exemplary embodiments illustrated in the drawings, and specific language will be used herein to describe the same, It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In accordance with one example embodiment, a combiner can comprise a septum layer and first and second housing layers on either side of the septum layer. The combiner can comprise a linear array of dual polarized ports connected via H-plane T-junction type combiner/dividers to a common port. In further example embodiments, a stack of combiners can be connected side by side to form a two dimensional grid of ports. An aperture horn plate can be attached to the face of the two dimensional grid of ports. An aperture grid plate can be attached to the face of the aperture horn plate. And an aperture close out can be attached to the face of the aperture grid plate.

With reference now to FIG. 1, in an example embodiment, a combiner 100 can be a waveguide structure. Combiner 100 can comprise a single port 110 and a linear array of ports 190. The linear array of ports can comprise any suitable number of ports. The ports 190 can be each connected, through power combiners/dividers to common port 110. Thus, combiner 100 can comprise a one port to many port waveguide device.

Combiner 100 can be a waveguide power divider. Combiner 100 can be a waveguide power combiner. In an example embodiment, combiner 100 can be both a waveguide power divider and a waveguide power combiner. For example, combiner 100 can be used in a radio frequency ("RF") antenna transceiver for simultaneously sending and receiving RF signals, For convenience in describing combiner 100, it may at times be described only from the perspective of a waveguide power divider. As such, combiner 100 can comprise a single input port 110 and multiple output ports 190. It should be understood, however, that the description of combiner 100 may also cover a waveguide power combiner (and vice versa) where the same multiple output ports 190 can be input ports, and the single port 110 can be an output port. For simplicity, the single port 110 may be referred to herein as a common port. Common port 110 can be the input port in a waveguide power divider and an output port in a waveguide power combiner. More generally, combiner 100 can comprise two input ports 110, 110' and multiple output ports 190 common to input ports 110, 110'. The multiple output ports 190 can be dual-polarized, and more specifically can be dual circular polarized supporting right-hand circular polarization (RHCP) and left-hand circular polarization (LHCP) simultaneously. In this configuration port 110 may be configured to correspond to RHCP and port 110' may be configured to correspond to LHCP. In this configuration combiner 100 has N output ports 190 and two input ports 110, 110' and may be described as a N×2 combiner.

With reference again to FIG. 1, a Cartesian coordinate system can be useful for describing the relative relationships and orientations of the waveguides, the ports, and the other components of combiner 100. The coordinate system can comprise an X axis, a Y axis, and a Z axis, wherein each axis is perpendicular to the other two axis. Combiner 100 can have a roughly rectangular shape. Combiner 100 can comprise a top side 120, a bottom side 150, an output side 130, and a common port side 140. Top side 120 can be opposite the bottom side, and both can lie in planes parallel with the plane defined by the Y axis and Z axis, separated by the height 121 of combiner 100. Output side 130 can be opposite common port side 140, and both can lie in planes parallel with the plane defined by the X axis and Y axis, separated by a length (or depth) 122. Combiner 100 can further have a width 123 representing the side to side distance across combiner 100 perpendicular to the length direction.

In an example embodiment, the height can be less than the depth which can be less than the width. In particular, combiner 100 can have an aspect ratio of 0.75/2.5/31 inches H/D/W. An example embodiment can have a width (W) that spans the full width of the antenna array using combiner 100. The height (H) can be constrained by the antenna array element spacing that can be both frequency band and performance dependent. In an example embodiment, the height can be less than or equal to one wavelength at the highest operating frequency. The depth (D) can be significant to achieve an overall antenna assembly depth and can directly impact the swept volume occupied by the antenna system when the antenna is dynamically pointed in mobile applications. The swept volume can be significant to the drag on an aircraft and to the service cost of associated fuel consumption.

With this orientation, combiner 100 can be configured to transmit and receive at its outputs/inputs in the plus and minus Z axis direction. In other words, the ports 190 can open in the Z axis direction. Combiner 100 can comprise at least 10 output ports, at least 20 output ports, at least 32 output ports, or at least 40 output ports. Moreover, combiner 100 can comprise any suitable number of output ports 190. Output ports 190 can be formed as a linear array of individual ports 190. The linear array can be lined up in parallel with the Y axis direction. In various example embodiments, output ports 190 can support operation of a single CP signal or can support dual CP signals.

Figure 2:
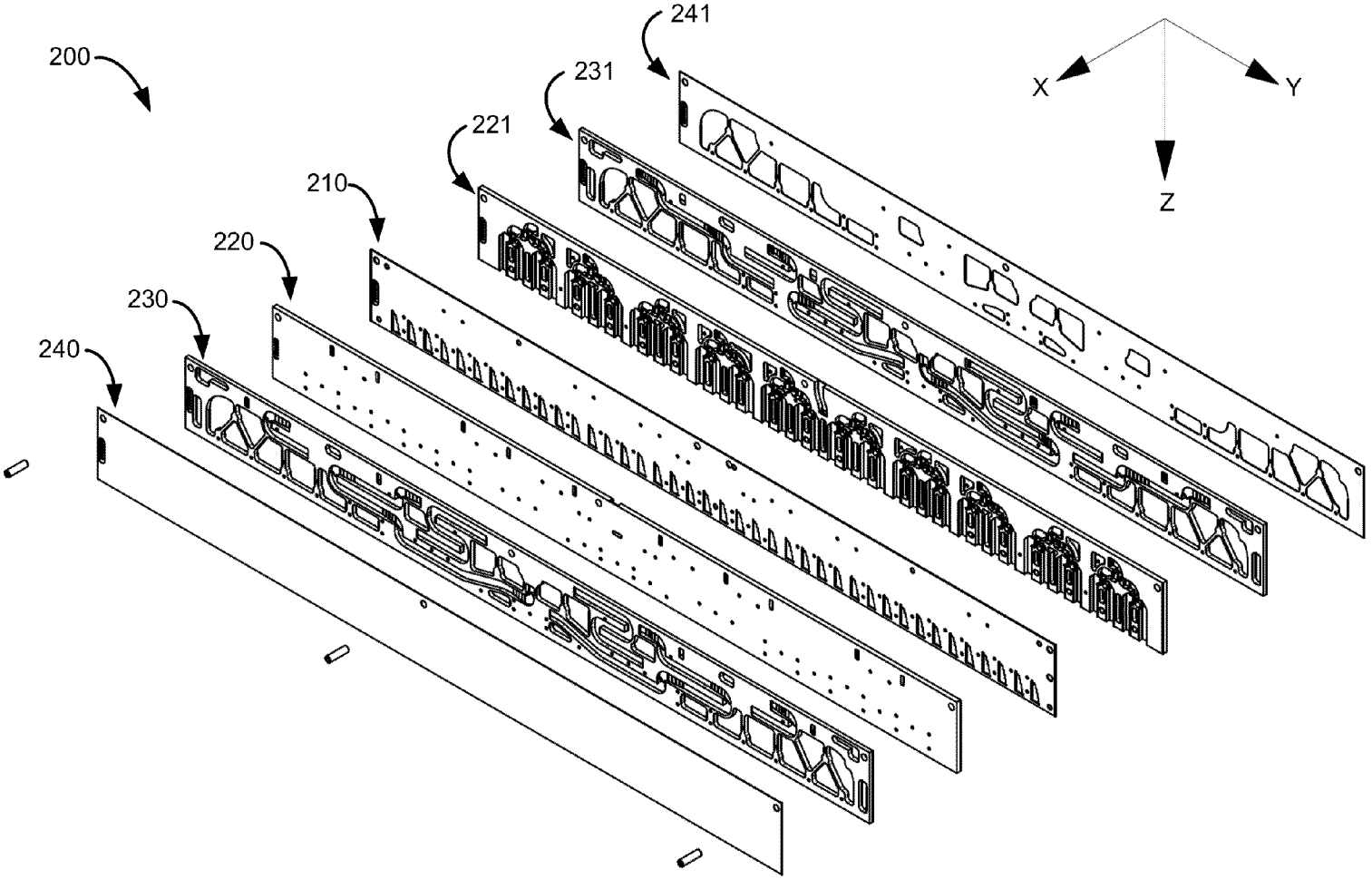
FIG. 2 is a perspective exploded view of an example azimuth combiner.
Figure 3:
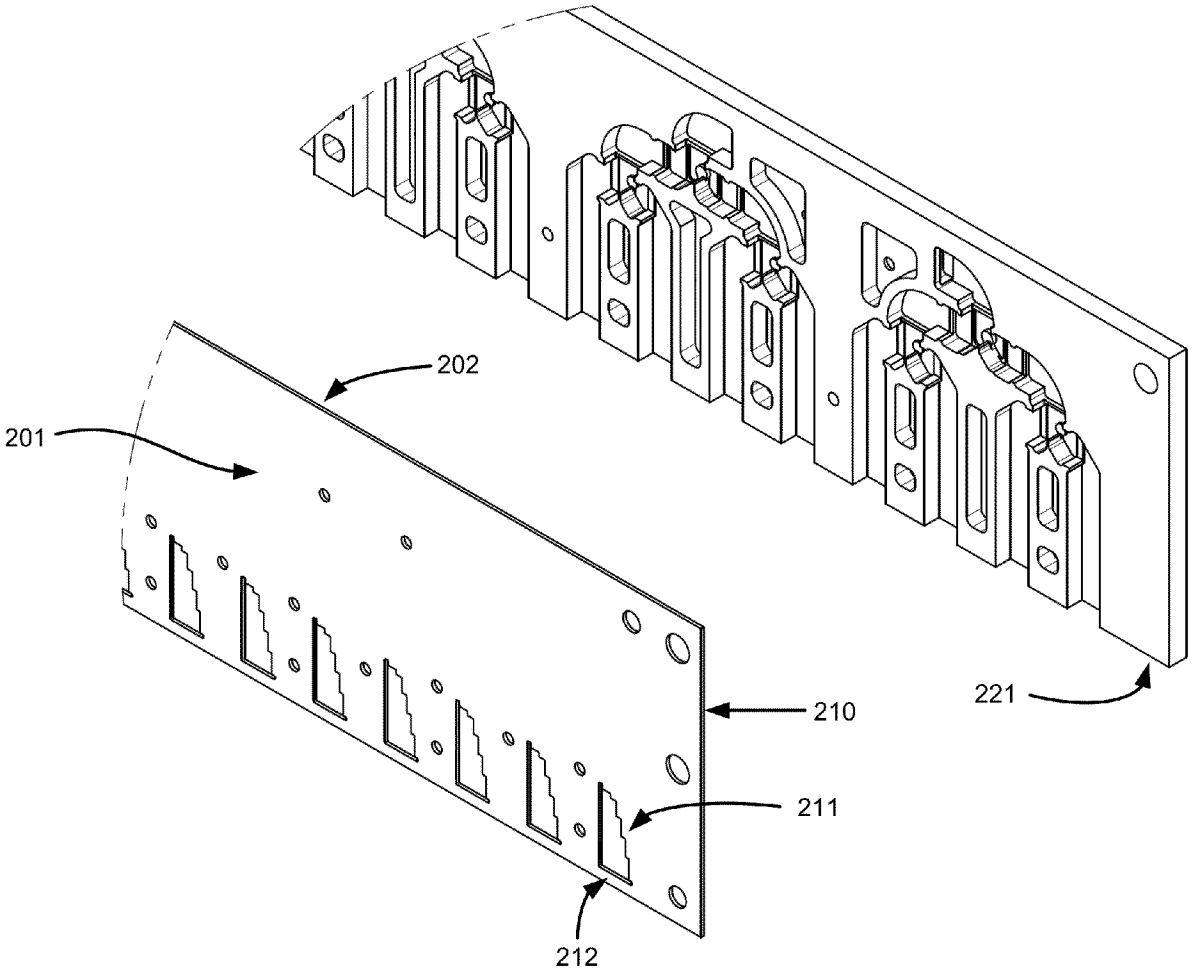
FIG. 3 is a perspective exploded view of an example azimuth combiner with a close up of an example septum layer.

With reference now to FIGS. 2 and 3, combiner 200 can comprise a septum layer 210. Septum layer 210 can be a thin flat metal structure. In another example embodiment, septum layer 210 can be a dielectric plate if the dielectric is plated on all surfaces with an electrical conductor having sufficient thickness of approximately 3 or more skin depths at the operational frequency band. Septum layer 210 can be oriented in a first plane (a "septum layer plane") substantially parallel with the Y-Z axis plane. Septum layer 210 can have formed therein a septum polarizer 211 that may also be described as a septum divider 211. The septum polarizer/divider 211 can be configured to depolarize a signal in a circular polarization wave state and route the signal to one side or the other depending on the polarization state. For example, a RHCP signal can be routed to the top side of septum layer 201 whereas a LHCP signal can be routed to the bottom side of septum layer 210. Thus, septum polarizer/divider 211 can be configured to cause signal separation based upon polarization state. Stated another way, septum divider 211 can be configured to divide signals at ports 190 in accordance with their polarized wave state. The subsequent combining of signal energy among ports 190 can be carried out by the power combiner/divider associated with RHCP or in an example embodiment, multiple septum dividers can be formed in septum layer 210. For example, the number of septum dividers 211 in septum layer 210 can equal the number of output ports 190 in combiner 100. The septum divider can be a stepped divider. In other example embodiments, the septum divider may be a continuous shape. Moreover, septum divider 211 can be any suitable type of septum divider. In an example embodiment, the septum dividers can form &plane dual band septum polarizers.

In an example embodiment, the septum divider 211 can be formed by machining, etching, fine blanking, punching, wire electrical discharge machining (EDM), or stamping out material from a sheet of metal. In an example embodiment, a portion of metal 212 can be initially left in septum layer 210 near the input side of septum divider 211 for manufacturing and machining convenience. Once combiner 100 is assembled, the face side 130 can be machined or wire EDM down to remove the portion of metal 212. Thus, after machining, ports 190 can be un-bisected at their openings. Septum divider can be from 0.010 to 0.125inches thick, 0.015 to 0.062 inches thick, or 0.020 to 0.040 inches thick. Moreover, septum divider 211 can be any suitable thickness.

Septum divider can be configured to split a signal entering output port 190 into two separate waveguide signals. The two separate waveguide signals can be associated with the orthogonal polarization senses (RHCP, LHCP) of dual circular polarization (CP). Septum divider can also be configured to form an output signal, to be sent from output port 190, by combining two signals coming to output port 190 from two waveguides. Septum layer 210 can be configured to evenly bisect each port of the linear array of ports 190. In other words, septum layer can be configured to be located in the middle of a septum polarizer formed in a waveguide surrounding the septum divider 211. This septum polarizer can comprise a waveguide having a first end and a second end, the first end can comprise an undivided waveguide, and the second end comprising two waveguides divided by a septum divider into a right hand circular polarized (RHCP) waveguide channel and a left hand circular polarized (UUCP) waveguide channel. Septum layer 210 can comprise a first side 201 and a second side 202, opposite first side 201. Septum layer 210 can provide a boundary between a waveguide power combiner/divide for a first polarization and a waveguide power combiner/divider for a second polarization.

Figure 4:
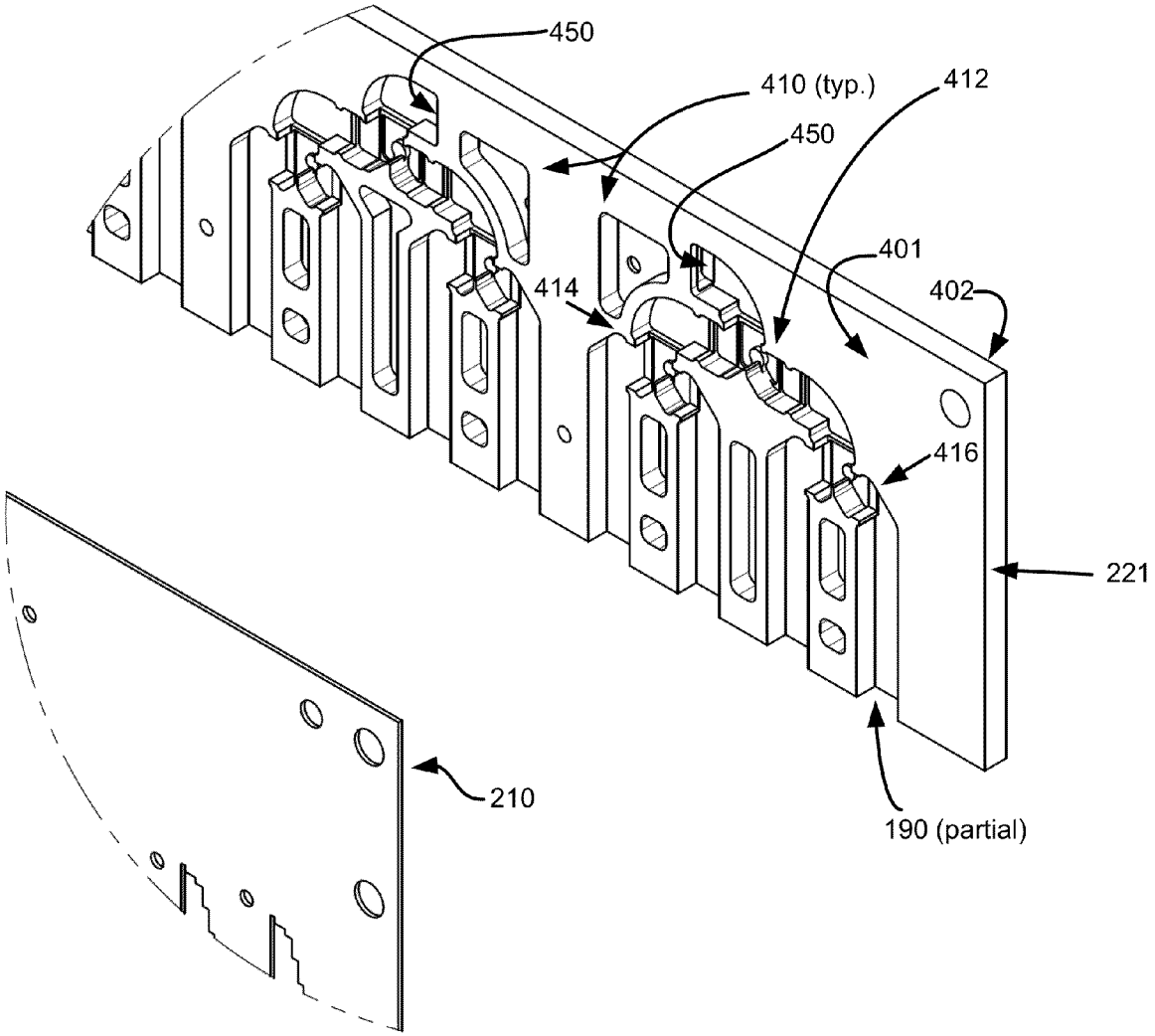
FIG. 4 is a perspective exploded view of an example azimuth combiner with a close up of an example inner housing layer.

With reference now to FIGS. 2 and 4, combiner 200 can comprise a first inner housing layer 220 and a second inner housing layer 221. First and second inner housing layers (220, 221) can be somewhat thin flat metal structures. In another example embodiment, first and second inner housings layers (220, 221) can be a dielectric composite material that has an electrical conductor plating on all surfaces of at least three skin depths thickness across the operational frequency band. First inner housing layer 220 can be oriented in a plane (a "first inner housing layer plane") substantially parallel with the Y-Z axis plane. Second inner housing layer 221 can also be oriented in another plane (a "second inner housing layer plane") substantially parallel with the Y-Z, axis plane.

First and second inner housing layers (220, 221) can comprise waveguide combiner dividers. First and second inner housing layers (220, 221) can be formed by forming waveguides and waveguide combiners/dividers in the respective layers. The waveguides and combiners/dividers can be formed by machining or probe EDM to remove material out of a layer of metal. At low frequencies it may be possible to cast or injection mold the inner housing and apply a conducting plating if appropriate. The material can be removed from a first side 401 (an "exposed waveguide side") of first inner housing layer 220, such that the waveguides have a bottom and side walls, but no top. Moreover, the second side 402 of first inner housing layer 220 can be formed to have no exposed waveguides, and/or be substantially smooth. The waveguides can be similarly formed in second inner housing layer 221. In an example embodiment the first and second inner housing layers 221 can be mirror image duplicates about the plane of the septum layer 210.

First and second inner housing layers (220, 221) can be from 0.1 to 0.6 inches thick, 0.150 to 0.250 inches thick, or 0.150 to 0.200 inches thick. Moreover, first and second inner housing layers (220, 221) can be any suitable thickness.

In an example embodiment, a first side (exposed waveguide side) 401 of first inner housing layer 220 can be attached to a first side 201 of septum layer 210. Similarly, a first side (exposed waveguide side) 401 of second inner housing layer 221 can be attached to a second side 202 of septum layer 210. Thus, a sandwich can be formed with septum layer 210 attached between first and second inner housing layers (220, 221). Moreover, the exposed waveguide sides 401 of the inner housing layers (220, 221) can be facing septum layer 210. Septum layer 210 can be configured to cap the exposed waveguides of the inner housing layers everywhere except where the several septum dividers 212 have no material between the two inner housing layers. Thus, the septum layer plane, and first and second inner housing layer planes can be parallel to each other and to a plane defined by the Y axis and the Z axis.

Thus, combiner 200 comprises ports 190 that can receive an RF signal and separate it into two separate signals—one in waveguides on a first side of septum polarizer 210, and the other in waveguides on a second side of septum polarizer 210. In an example embodiment, the signal received on one side of the septum layer can be right hand circular polarized (RHCP), and the signal received on the other side of the septum layer can be left hand circular polarized (LHCP). The signal received at the individual ports 190 can be combined to reduce the number of waveguide carrying the signal. In an example embodiment, first and second inner housing layers (220 and 221) each comprises waveguide combiners/dividers ("waveguide combiners"). In an example embodiment, the waveguide combiners can be H-plane T-junction type waveguide combiners. Although various suitable H-plane T-junction type waveguide combiner can be used, in one example embodiment, the H-plane T-junction waveguide combiner comprises an offset asymmetric septum as discussed in more detail in a co-filed patent application, U.S. application Ser. No. 13/707,049, entitled "In-Phase H-Plane Waveguide T-Junction With E-Plane Septum," filed Dec. 6, 2012, and incorporated herein by reference. The H-plane T-junctions can he oriented in planes parallel to the plane defined by the Y axis and the Z axis. In various example embodiments, the H-plane T-junction can be at least one of a power combiner and a power divider.

For example, first and second inner housing layers (220, 221) can comprise a four to one combiner 410. The 4/1 combiner can be formed with a single 2/1 combiner 412 having another 2/1 combiner 414 and 416 on each output branch of the single 2/1 combiner. Moreover, first and second inner housing layers (220, 221) can comprise multiple four to one combiners 410. In an example embodiment, first and second inner housing layers (220, 221) can comprise ten combiners of the 4/1 type—thus combining 40 waveguides into 10. In other example embodiments, 2/1 combiners, 8/1 combiners, or other suitable combiners can be used. In general, first and second inner housing layer (220, 221) can be configured to connect waveguides at multiple output ports 190 with a smaller number of waveguides.

In the event that combining in the inner housing layer nevertheless has not combined the various ports 190 into a single waveguide, combiner 100 can be configured to have a waveguide transitions from the inner housing layer to an outer housing layer. The outer housing layer can be configured to receive the signals from the inner housing layer and further combine the signals. Thus, first and second inner housing layers (220, 221) can comprise waveguide transitions 450. Waveguide transitions 450 can extend a waveguide through second side 402. Thus, multiple waveguide combiners 410 in inner housing layer 220/221 can have an input at waveguide transition 450 and multiple outputs 190.

Figure 5:
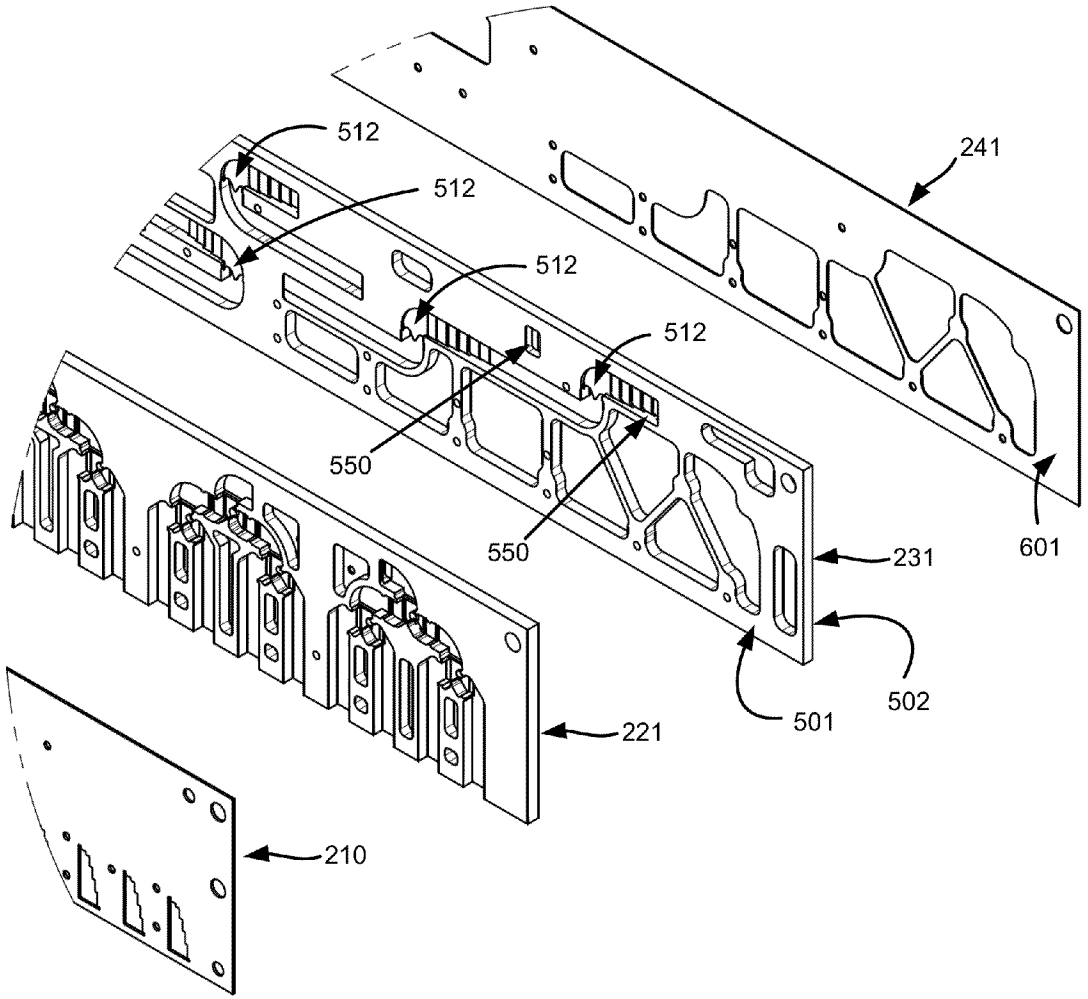
FIG. 5 is a perspective exploded view of an example azimuth combiner with a close up of an example outer housing layer.

With reference now to FIGS. 2 and 5, combiner 200 can comprise a first outer housing layer 230 and a second outer housing layer 231. First and second outer housing layers (230, 231) can be somewhat thin flat metal structures. In another example embodiment, the first and second outer housings layers may be a dielectric composite material that has an electrical conductor plating on all surfaces of at least three skin depths thickness across the operational frequency band. First outer housing layer 230 can be oriented in a plane (a "first outer housing layer plane") substantially parallel with the Y-Z axis plane. Second outer housing layer 231 can also be oriented in another plane (a "second outer housing layer plane") substantially parallel with the Y-Z axis plane.

First and second outer housing layers (230, 231) can comprise waveguide combiner/dividers. First and second outer housing layers (230, 231) can be formed by forming waveguides and waveguide combiners/dividers in the respective layers. The waveguides and combiners/dividers can be formed by machining or probe EDM removing material out of both sides of a layer of metal. At low frequencies it may be possible to cast or injection mold the outer housing and apply a conducting plating if appropriate. The material can be removed from a first side 501 (an "interior side") of first outer housing layer 230. The material can also be removed from a second side 502 (an "exterior side") of first outer housing layer 230. First side 501 can be located opposite second side 502. In some portions, the material can be removed through the entire thickness of the outer housing layer to form the waveguides. In other portions, material can be removed from both sides leaving some material between the first and second sides of the outer housing layer to form H-plane T-junctions with E-plane septums. The waveguides can be similarly formed in second outer housing layer 231.

First and second outer housing layers (230, 231) can be from 0.060 to 0.500 inches thick, 0.090 to 0.300 inches thick, or 0.100 to 0.15 inches thick. Moreover, first and second outer housing layers (230, 231) can be any suitable thickness.

In an example embodiment, a first side (interior side) 501 of first outer housing layer 230 can be attached to a second side 402 of inner housing layer 220. Similarly, a first side (interior side) 501 of second outer housing layer 231 can be attached to a second side 402 of inner housing layer 221. Thus, a sandwich can be formed with septum layer 210 and inner housing layers attached between first and second outer housing layers (230, 231). Moreover, the interior sides 501 of the outer housing layers (230, 231) can be facing the inner housing layers 220, 221 respectively. Each inner housing layer 220/221 can be configured to cover one side of the exposed waveguides of the outer housing layers. Thus, the septum layer plane, first and second inner housing layer planes, and first and second outer housing layer planes, can be parallel to each other and to a plane defined by the Y axis and the Z axis.

The outer housing layer can combine the multiple waveguides connected to the inner housing layer into a single waveguide. In an example embodiment, first and second outer housing layers (230 and 231) each comprises waveguide combiners/dividers ("waveguide combiners"). In an example embodiment, the waveguide combiners can be H-plane T-junction type waveguide combiners. Although various suitable H-plane T-junction type waveguide combiner can be used, in one example embodiment, the H-plane T-junction waveguide combiner comprises an E-plane septum as discussed in more detail in a co-filed patent application, U.S. application Ser. No. 13/707,049, entitled "In-Phase H-Plane Waveguide T-Junction With E-Plane Septum," filed Dec. 6, 2012, and incorporated herein by reference. The H-plane T-junctions with H-plane septum can be oriented in planes parallel to the plane defined by the Y axis and the Z axis.

For example, first and second outer housing layers (230, 231) can comprise as 10 to one combiner. The 10/1 combiner can be formed with a 9 2/1 combiners 512 attached in a decision tree like structure. Thus, first and second outer housing layers (230, 231) can be configured to combine 10 waveguides into one. In other example embodiments, other combiner structures or various other suitable combiners can be used. Moreover, first and second outer housing layers (230, 231) can be configured to have a waveguide transitions from the outer housing layer back to the respective inner housing layer. The inner housing layer can be configured to receive the single signal from the outer housing layer. Inner housing layers 220/221 may provide their respective single signals from the outer housing layer to the common port. In an example embodiment, these two single signals can be provided to the common port as separate signals, separated by septum layer 210.

First and second outer housing layers (230, 231) can comprise waveguide transitions 550. In one example embodiment, waveguide transitions 550 can guide a waveguide signal to the interior side 501 and in another example embodiment, 550 can guide a waveguide signal to the exterior side 502. This can be useful, for example, to set up immediate use of an h-plane T-junction with c-plane septum, where the approach to the T-junction can be configured to be from opposite sides of the outer housing layer. The ability to define the outer housing as a central member of c-plane septum power divider also can offer flexibility in signal routing by virtue of waveguide channels formed on opposite sides. The signal from a first waveguide port 450 and a second adjacent waveguide port 450 may be connected through respective ports 550 to opposite sides of the outer housing.

With reference now to FIG. 2, combiner 200 can comprise a first cover layer 240 and a second cover layer 241. First cover layers (240, 241) can be thin flat metal structures. In another example embodiment, first and second cover layers 240 can be a dielectric composite material that has an electrical conductor plating on all surfaces of at least three skin depths thickness across the operational frequency band. First cover layer 240 can be oriented in a plane (a "first cover layer plane") substantially parallel with the Y-Z axis plane. Second cover layer 241 can also be oriented in another plane (a "second cover layer plane") substantially parallel with the Y-Z axis plane.

First and second cover layers (240, 241) can be from 0.010 to 0.033 inches thick, 0.012 to 0.030 inches thick, or 0.015 to 0.025 inches thick. Moreover, first and second cover layers (240, 241) can be any suitable thickness. As mentioned before, the combined total of the seven layers of combiner 200 can be less than or equal to one wavelength at the highest operating frequency.

In an example embodiment, a first side 601 of first cover layer 240 can be attached to second side 502 of outer housing layer 230. Similarly, a first side 601 of second cover layer 241 can be attached to second side 502 of outer housing layer 231. Thus, a sandwich can be formed with septum layer 210, both inner housing layers (220, 221), and both outer housing layers (230, 231) attached between first and second cover layers (240/241). Cover layers 240, 241 can be configured to cap the exposed waveguides of the outer housing layers everywhere on the exterior side of outer housing layers (230, 231). Thus, the septum layer plane, first and second inner housing layer planes, first and second outer housing layer planes, and first and second cover layer planes can be parallel to each other and to a plane defined by the Y axis and the Z axis.

Combiner 100 can be made out of aluminum, copper, zinc, steel, or plated composite dielectric. Furthermore, combiner 100 can be made out of any suitable materials. Septum layer 210, inner housing layers 220/221, outer housing layers 230/231, and cover layers 240/241 can be made of the same material or different materials.

Figure 6:
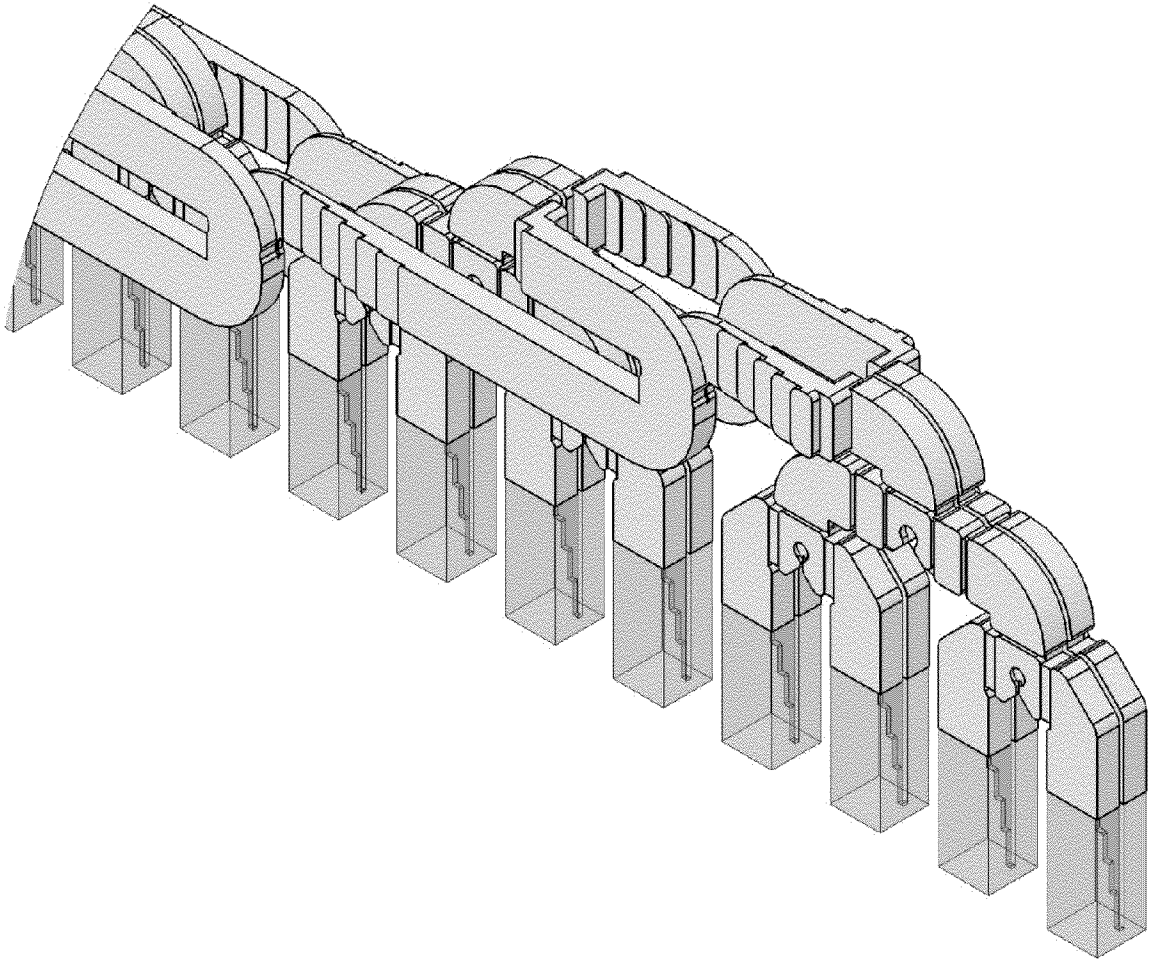
FIG. 6 is a perspective air model of waveguide channels of an example azimuth combiner.

Although described herein with some specifics as to the types of combiners and where certain combining takes place on the various levels, in various embodiments, combiner 100 can be formed such that some combining takes place on a first layer, further combining takes place on a second layer, and then the remaining combining takes place back on the first layer. Moreover, combiner 100 can comprise further combining layers in addition to the two combining layers described herein. Various suitable arrangement of combiners in at least one layer on either side of a septum layer can be used to combine a linear array of ports to a common port. FIG. 6 illustrates an "air" model of an example waveguide path in an example combiner 100.

Figure 7:
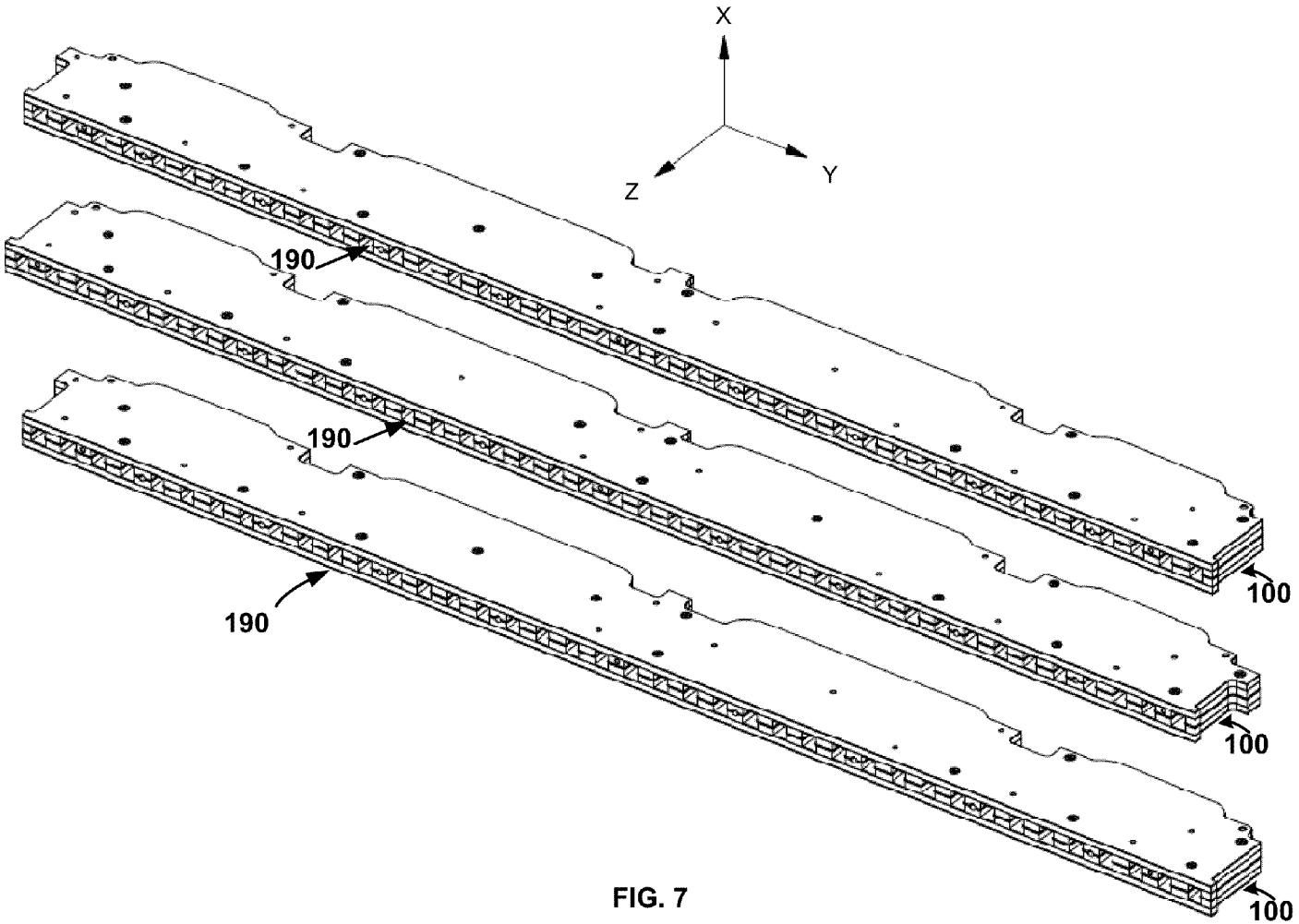
FIG. 7 is a perspective exploded view of an example stack of azimuth combiners.
Figure 10:
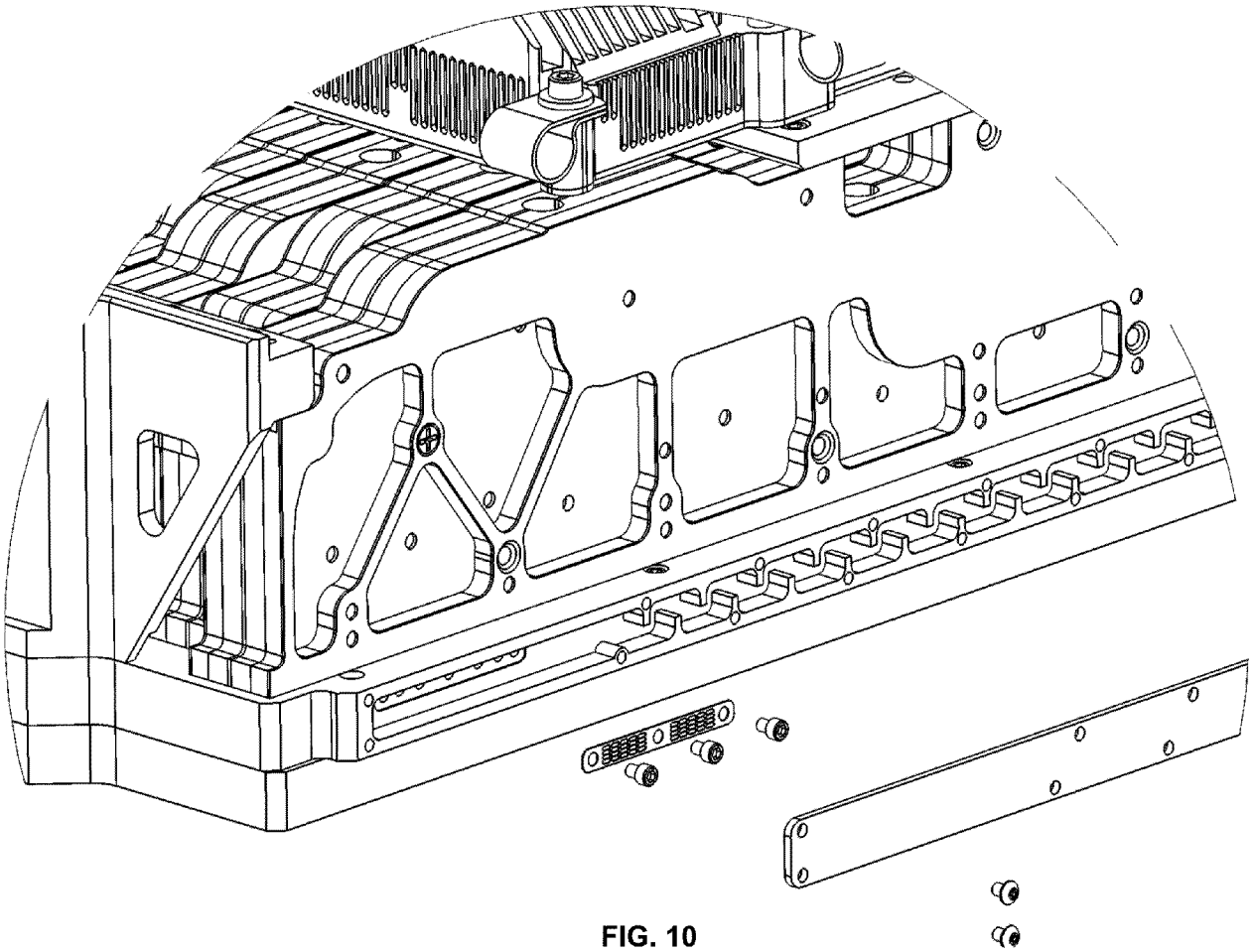
FIG. 10 is a perspective view of an example RF antenna system with a close up showing the stack of example azimuth combiners.
Figure 11:
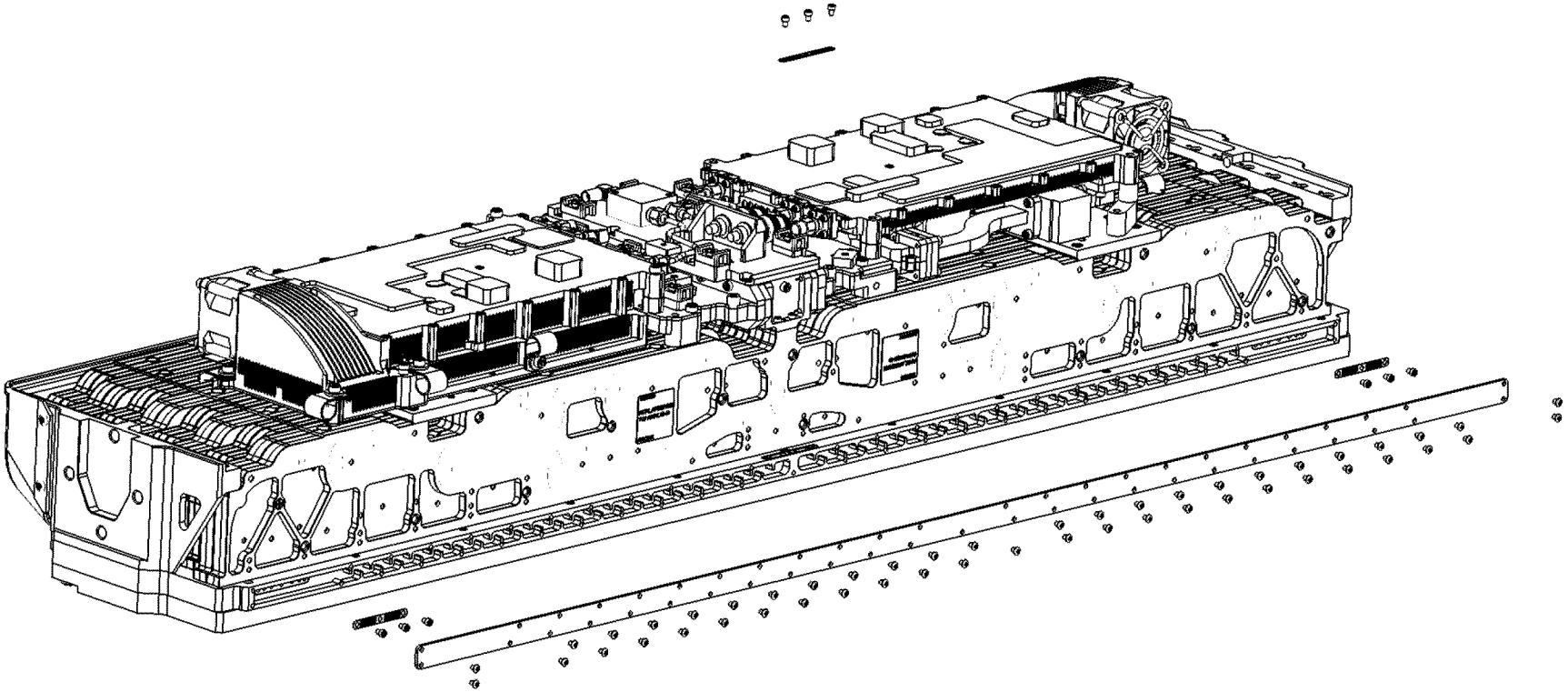
FIG. 11 is another perspective view of an example RF antenna system showing the stack of example azimuth combiners.

With reference now to FIGS. 7, 10 and 11, in an example embodiment, at least two combiners 100 ("combiner sticks") can be attached together. A first combiner 100 can be attached on its first side 120 to a second side 150 of a second combiner 100. In other words, at least two combiners 100 can be stacked in the X direction forming a stack of combiners 100, next to each other, in planes parallel to each other and to the plane defined by the Z axis and Y axis.

In an example embodiment, the stack of combiner sticks can be configured to have a two dimensional array of output ports 190. The face of this two dimensional array of output ports can be facing in the Z direction, and can form a plane parallel to the plane defined by the X axis and Y axis. As mentioned before, the face of the stack of combiner sticks can be machined to form a flat surface and to remove a portion of material from the septum layer 210. In an example embodiment, each combiner stick can be referred to as an azimuth combiner because the linear array of ports associated with each combiner stick can be in an azimuth direction of the aperture array formed by the stacking of the combiners.

Figure 8:
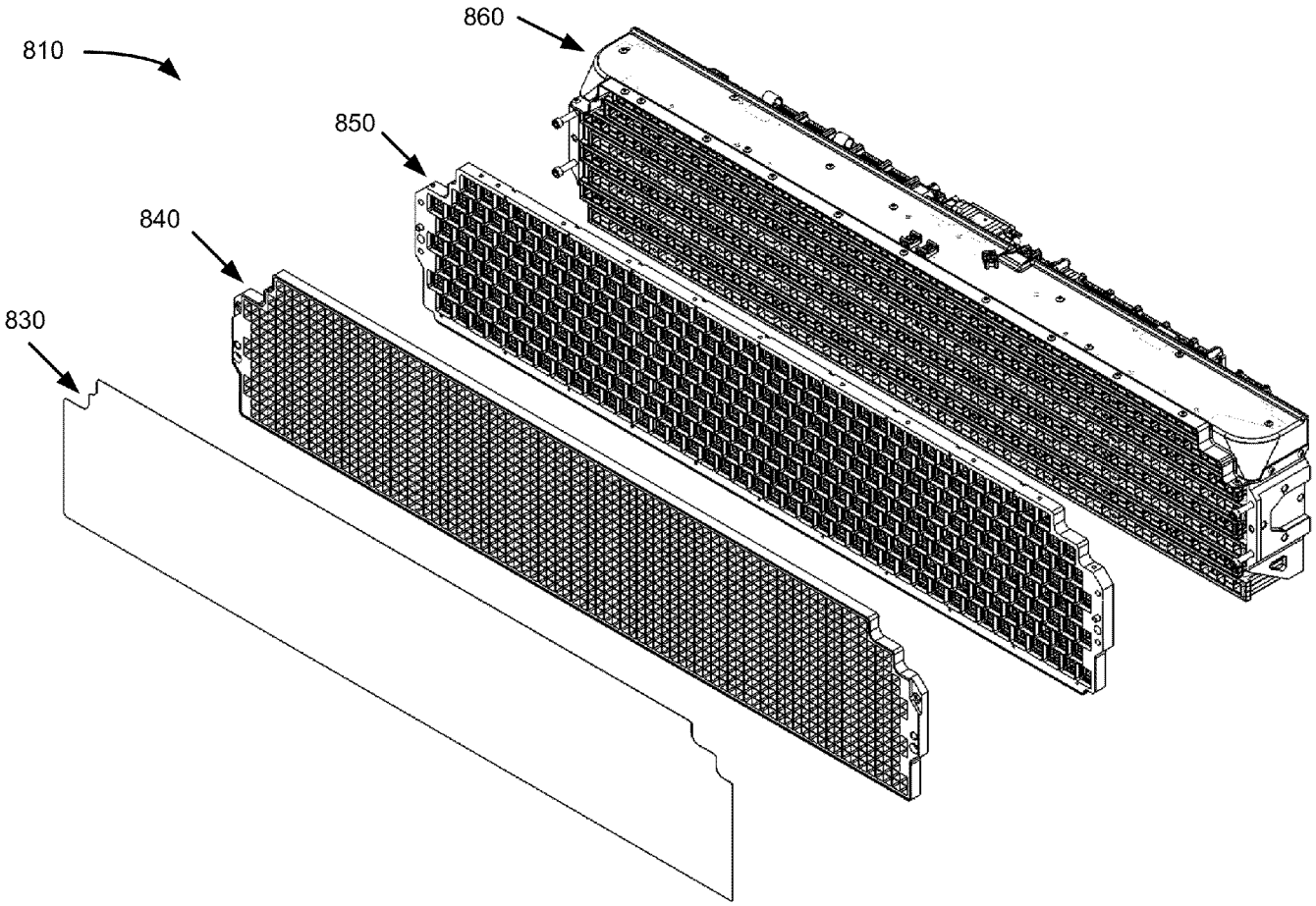
FIG. 8 is a perspective exploded view of an example RF antenna aperture having a stack of azimuth combiners, a horn plate, an aperture grid plate and an aperture close out.

In an example embodiment, and with reference, now to FIG. 8, a stack of combiner sticks or stack of azimuth combiners can be identified by reference number 860. An aperture horn plate 850 can be connected to the face of the stack of azimuth combiners 860. An aperture grid plate 840 can be connected to the aperture horn plate on the side opposite the stack of azimuth combiners 860. An aperture close out 830 can be connected to the aperture grid plate 840 on the side opposite the aperture horn plate 850. The aperture close out 830 can act as a RF window or radome and is a relatively thin fiber reinforced dielectric sheet. Each of these plates (aperture horn plate 850, aperture grid plate 840, and aperture closeout 830) can be located in planes parallel to the face of the stack of azimuth combiners 860 and to the plane defined by the X axis and Y axis (in planes perpendicular to the Z axis). Thus, it is noted that the stack of azimuth combiners can be perpendicular to the horn aperture layer. In an example embodiment, the combination shown along with an elevation power combiner network forms an antenna aperture 810.

The aperture horn plate (or layer) can comprise an array of horn elements. Each horn element can be located in the array to correspond with one of the ports in the stack of azimuth combiners 860. Each horn element can be a flared horn element, a stepped horn element and/or the like. In one example embodiment, a four step horn can be used. Moreover, any suitable horn structure can be used in horn plate 850. Each horn can comprise a horn aperture on one end of the horn and a horn port opposite the horn aperture. The horn port can be configured to connect with an output port 190 of the azimuth combiner. The aperture horn plate 850 can comprise a plurality of horns arranged in a rectilinear array. In an example embodiment, the horn elements in the horn lattice can be staggered ½ the horn lattice. The azimuth combiners 100 can be staggered to correspond to the horn locations. This row to row stagger can improve the effectiveness of the grid layer to suppress grating lobes associated with the horn lattice. The staggering can be configured to eliminate two of six possible grating lobes. Thus, the work of the grid plate is simplified to being configured to reduce four symmetrical off axis grating lobes, which helps improve its effectiveness of grating lobe suppression over an operational frequency band. The aperture grid plate (or layer) 840 can comprise plural mode matching features. Aperture grid plate 840 can comprise four equal sized apertures for subdividing the horn aperture into four smaller apertures. The aperture grid plate 840 can comprise a plurality of grid plates arranged in a rectilinear array.

The aperture close out 830 can comprise a radome, protective cover, such as can be made out of Nelco NY9220 fiber reinforced polytetrafluoroethylene (PTFE) laminate manufactured by Park Electrochemical Corp. in Tempe, Ariz.

Although manufactured in panels, at its lowest level, each antenna element in the array comprises a septum polarizer, a horn element, and a grid plate. In an example embodiment, the dual-band array antenna can be formed from a plurality of such antenna elements arranged in a rectilinear array.

Figure 9:
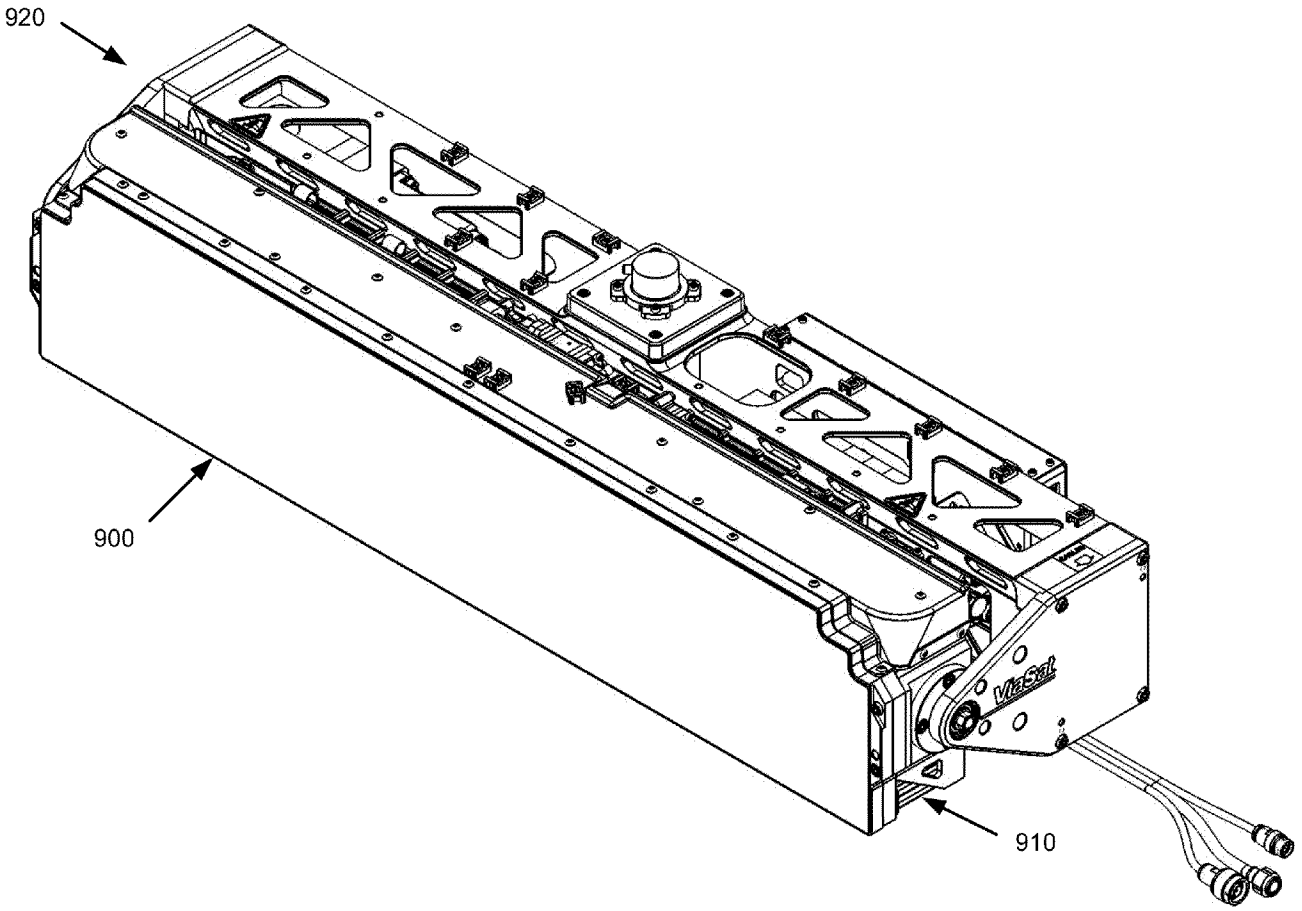
FIG. 9 is a perspective view of an example RF antenna system.

With reference to FIG. 9, an example assembled antenna is illustrated. An RF antenna 900 can comprise an antenna aperture 910 and a positioner 920. In an example embodiment, antenna aperture 910 can comprise an array of antenna horn elements connected via a combiner network. Positioner 920 can be a single or multi-axis mechanical antenna pointing system. Positioner 920 can be configured to point antenna aperture 910 at a satellite. In particular, positioner 920 can be configured to point antenna aperture 910 at a satellite as the RF antenna and/or satellite move relative to one another. For example, RF antenna system 900 can be located on an airplane. Antenna aperture 910 can be configured to send and receive RF signals between the satellite and RF antenna system 900. In this manner, RF antenna system 900 can be configured to facilitate providing communication, interact connectivity, and the like to passengers on a commercial airline. Moreover, in one example embodiment, RF antenna system 900 can provide RF signal communication to a satellite from an airborne or otherwise mobile platform, be it commercial, personal, or military. Although describe herein as an airborne RF antenna, the invention may not be so limited, and it should be appreciated that this description can be applicable to various suitable RF antenna solutions.

In an example embodiment, RF antenna system 900 can be a dual-circular polarized, dual-beam forming network (BFN), dual-band antenna. In an example embodiment, RF antenna system 900 can be an integrated power combiner/divider. RF antenna system 900 can be a full duplex transmit and receive antenna comprising a two dimensional array of elements. For example, RF antenna system 900 can comprise an aperture having 8×40 elements in the array. In this example embodiment, there can be 40 combiner ports 190 per stick (40 LHCP and 40 RHCP) with 8 sticks or azimuth combiners stacked on each other.

In an example embodiment, RF antenna system 900 comprises an array of antenna elements that can be configured to produce independent left-hand circular polarization and right-hand circular polarization, simultaneously. Moreover, each port of the linear array of ports for a combiner stick supports dual polarized waveguide mode signals.

The transceiver antenna can be a dual band combiner having first and second frequency bands of operation. In accordance with various aspects, the first band can be a receive frequency band. In an example embodiment, the receive frequency band can be from 17.7 to 21.2 GHz, from 17.7 to 20.2 GHz, or from 18.3 to 20.2 GHz. Moreover, the receive frequency band can be any suitable frequency band. In accordance with various aspects, the second band can be a transmit frequency band. In an example embodiment, the transmit frequency band can be from 27.5 to 31.0 GHz, from 27.5 to 30.0 GHz, or from 28.1 to 30.0 GHz. Moreover, the transmit frequency band can be any suitable frequency band.

In describing the present invention, the following terminology will be used: The singular forms "a," "an" and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential."

What is claimed is:

1. A device comprising:

a first housing layer comprising a first set of waveguides coupled to a first network of combiner/dividers;

a second housing layer comprising a second set of waveguides coupled to a second network of combiner/dividers; and a septum layer between the first housing layer and the second housing layer, the septum layer comprising a plurality of septum polarizers dividing openings of the first set of waveguides and openings of the second set of waveguides to define a linear array of ports.

2. The device of claim 1, wherein a septum polarizer of the plurality of septum polarizers divides an opening of a first waveguide of the first set of waveguides and an opening of a second waveguide of the second set of waveguides to define a port of the linear array of ports.

3. The device of claim 2, wherein the septum polarizer converts a signal between a polarized state at the port and a first polarization component in the first waveguide and a second polarization component in the second waveguide.

4. The device of claim 3, wherein the first polarization component corresponds to a first polarized state of the signal, and the second polarization component corresponds to a second polarized state of the signal, the first polarized state orthogonal to the second polarized state.

5. The device of claim 1, further comprising an array of antenna elements to communicate signals with the linear array of ports.

6. The device of claim 5, wherein the septum polarizers convert the signals between polarized states at ports of the linear array of ports and individual first polarization components in waveguides of the first set of waveguides and individual second polarization components in waveguides of the second set of waveguides.

7. The device of claim 6, wherein the first polarization components correspond to a first polarization at apertures of the array of antenna elements, and the second polarization components correspond to a second polarization at the apertures.

8. The device of claim 7, wherein the first polarization is a first circular polarization, and the second polarization is a second circular polarization.

9. The device of claim 1, wherein the openings of the first set of waveguides are mirror images of the openings of the second set of waveguides about the septum layer such that the plurality of septum polarizers evenly bisect each port of the linear array of ports.

10. The device of claim 1, wherein the combiner/dividers of the first network of combiner/dividers are minor images the combiner/dividers of the second network of combiner/dividers about the septum layer.

11. The device of claim 1, further comprising a third housing layer on a side of the first housing layer opposite the septum layer, the third housing layer comprising a third network of combiner/dividers coupled between the first network of combiner/dividers and a common port.

12. The device of claim 11, wherein a signal path from the first set of waveguides to the common port extends along a first direction through the first network of combiner/dividers and extends along a second direction through the third network of combiner/dividers.

13. The device of claim 12, wherein the first direction is opposite the second direction.

14. The device of claim 11, wherein the openings of the first and second waveguides are on a first side of the device, and the common port is on a second side of the device and opposite the first side.

15. The device of claim 1, wherein portions of the septum layer form surfaces of the first and second sets of waveguides.

16. An antenna comprising:

a plurality of combiner structures stacked along a first direction, each combiner structure of the plurality of combiner structures comprising:

a first housing layer comprising a first set of waveguides coupled to a first network of combiner/dividers, wherein first openings of the first set of waveguides are arranged along a second direction perpendicular to the first direction, and the first openings open in a third direction perpendicular to the first direction and perpendicular to the second direction;

a second housing layer comprising a second set of waveguides coupled to a second network of combiner/dividers, wherein second openings of the second set of waveguides are arranged along the second direction, and the second openings open in the third direction; and a septum layer between the first housing layer and the second housing layer, the septum layer comprising a plurality of septum polarizers dividing the first openings and the second openings to define a linear array of ports, wherein the septum polarizers convert signals between polarized states at ports of the linear array of ports and individual first polarization components in waveguides of the first set of waveguides and individual second polarization components in waveguides of the second set of waveguides; and an array of antenna elements to communicate the signals with the linear array of ports of each of the plurality of combiner structures.

17. The antenna of claim 16, wherein the first polarization components correspond to a first polarization at apertures of the array of antenna elements, and the second polarization components correspond to a second polarization at the apertures.

18. The antenna of claim 16, wherein the array of antenna elements is a two-dimensional array extending along the first direction and the second direction.

19. The antenna of claim 16, wherein each combiner structure of the plurality of combiner structures comprises a third housing layer on a side of the first housing layer opposite the septum layer, the third housing layer comprising a third network of combiner/dividers coupled between the first network of combiner/dividers and a common port.

20. The device of claim 19, wherein a signal path from the first set of waveguides to the common port extends along a first direction through the first network of combiner/dividers and extends along a second direction through the third network of combiner/dividers.

* * * * *

UNITED STATES PATENT AND TRADEMARK OFFICE

CERTIFICATE OF CORRECTION

PATENT NO. : 8,988,300 B2
APPLICATION NO. : 13/707160
DATED : March 24, 2015
INVENTOR(S) : Donald L Runyon et al.

It is certified that error appears in the above-identified patent and that said Letters Patent is hereby corrected as shown below:

In the Claims

Column 13, line 7, delete “minor” and insert --mirror--

Signed and Sealed this
Sixth Day of October, 2015

Michelle K. Lee

Michelle K. Lee
*Director of the United States Patent and Trademark Office*